US009967654B2

(12) United States Patent
Huang

(10) Patent No.: US 9,967,654 B2
(45) Date of Patent: May 8, 2018

(54) MODULAR LOUDSPEAKER FOR POINT SOUND SOURCE AND MANUFACTURING METHOD THEREOF

(71) Applicant: TANG BAND INDUSTRIES CO., LTD., Zhejiang (CN)

(72) Inventor: Hsinmin Huang, Ningbo (CN)

(73) Assignee: TANG BAND INDUSTRIES CO., LTD., Ningbo, Zhejiang (CN)

( * ) Notice: Subject to any disclaimer, the term of this patent is extended or adjusted under 35 U.S.C. 154(b) by 0 days. days.

(21) Appl. No.: 15/032,626

(22) PCT Filed: Oct. 28, 2014

(86) PCT No.: PCT/CN2014/089616

§ 371 (c)(1),
(2) Date: Apr. 27, 2016

(87) PCT Pub. No.: WO2015/062460

PCT Pub. Date: May 7, 2015

(65) Prior Publication Data

US 2016/0277829 A1 Sep. 22, 2016

(30) Foreign Application Priority Data

Oct. 28, 2013 (CN) ..... 2013 1 0542883
Dec. 19, 2013 (CN) ..... 2013 1 0706046
Oct. 28, 2014 (WO) ..... PCT/CN2014/089616

(51) Int. Cl.
*H04R 25/00* (2006.01)
*H04R 1/28* (2006.01)
(Continued)

(52) U.S. Cl.
CPC ..... *H04R 1/2834* (2013.01); *H04R 1/283* (2013.01); *H04R 7/18* (2013.01); *H04R 9/06* (2013.01);
(Continued)

(58) Field of Classification Search
CPC ... H04R 1/2834; H04R 31/003; H04R 31/006
See application file for complete search history.

(56) References Cited

U.S. PATENT DOCUMENTS 2,713,396 A * 7/1955 Tavares ..... H04R 1/2834 181/163
5,903,656 A * 5/1999 D'Hoogh ..... H04R 1/2834 381/306

(Continued)

*Primary Examiner* — Matthew Eason
*Assistant Examiner* — Ryan Robinson
(74) *Attorney, Agent, or Firm* — Raymond Y. Chan; David and Raymond Patent Firm

(57) ABSTRACT

A modular speaker includes at least an active vibrator, at least a passive vibrator, and a module housing, wherein the active vibrator and the passive vibrator are coupled to the module housing to form a vibration cavity therewithin to share with the active vibrator and the passive vibrator. When the active vibrator is operated for sound generation in response to an audio signal input, the passive vibrator is driven to vibrate through the vibration cavity for auxiliary sound generation so as to produce a point sound with full range of frequencies. The point sound with full range of frequencies produced by the modular speaker includes treble region and bass region, such that the modular speaker is able to completely restore the audio signal input as the original form to enable the listener to hear the sound quality of original raw audio signal.

2 Claims, 18 Drawing Sheets

(51) Int. Cl.
*H04R 9/06* (2006.01)
*H04R 7/18* (2006.01)
*H04R 31/00* (2006.01)

(52) U.S. Cl.
CPC ..... *H04R 31/003* (2013.01); *H04R 31/006* (2013.01)

(56) References Cited

U.S. PATENT DOCUMENTS 6,176,345 B1 * 1/2001 Perkins ..... H04R 7/00 181/171
8,396,244 B2 * 3/2013 Huang ..... H04R 31/006 381/386
8,397,861 B1 * 3/2013 Xu ..... H04R 7/18 181/171
9,398,369 B2 * 7/2016 Yang ..... H04R 1/2834
2001/0024509 A1 * 9/2001 Carver ..... H04R 1/227 381/395
2011/0026751 A1 * 2/2011 Hilbowicki ..... H04R 1/2807 381/345
2013/0004008 A1 * 1/2013 Kuo ..... H04R 1/2834 381/349
2014/0334656 A1 * 11/2014 Lu ..... H04R 1/10 381/370

* cited by examiner

MODULAR LOUDSPEAKER FOR POINT SOUND SOURCE AND MANUFACTURING METHOD THEREOF

CROSS REFERENCE OF RELATED APPLICATION

This is a non-provisional application that claims priority to international application number PCT/CN2014/089616, international filing date Oct. 28, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a loudspeaker, and more particularly to a modular loudspeaker for a point sound source and its manufacturing method thereof, which can produce a sound point with full range of frequencies.

Description of Related Arts

Existing sound technologies artificially separate different sound source regions of a raw audio signal into treble region and bass region, wherein the treble region and bass region are then generated back to an audio sound by different speakers, such as treble speaker and bass speaker. However, it is a misconception that the raw audio signal is separated in response to different frequencies since human ears can naturally separate the raw audio signal into treble region and bass region by means of human auditory system. In other words, the existing sound technologies have a blind area that the audio signal as a single sound source must be converted into treble region and bass region in response to their frequencies by different sound converting mechanisms and then re-generated back to the audio sound as multiple sound sources by different sound generation mechanisms. Once the audio sound is re-generated back, human being can hear the audio sound at the treble region and bass region from the sound generation mechanisms. Since human ear is the most sophisticated instrument, there is unnecessary to separate the raw audio signal into treble region and bass region. In other words, when the raw audio signal enters into a human ear, the human ear can automatically separate the raw audio signal into treble region and bass region, such that human being can enjoy the full range of frequencies. In other words, the raw audio signal as the single sound source should not be separated into different frequencies by different sound converting mechanisms and should not be re-generated back to the audio sound as multiple sound sources by different sound generation mechanisms. The raw audio signal as the single sound source should be generated directly since human ear can automatically separate the raw audio signal from the single sound source.

SUMMARY OF THE PRESENT INVENTION

The invention is advantageous in that it provides a modular loudspeaker for a point sound source and its manufacturing method thereof, which can produce a sound point with full range of frequencies at the same time to enable listeners thereof obtaining an auditory enjoyment of the full range of frequencies of sound from the single point sound source.

Another advantage of the invention is to provide a modular loudspeaker for a point sound source and its manufacturing method thereof, wherein the treble region and bass region, including high pitch, middle pitch and the lower pitch, of the sound are generated at the same time, wherein the vibration of the full range frequencies of sound are intersected together in the modular loudspeaker as a point sound source to transmit to the listener's ears, such that the listener is able to listen the point sound source with the full range of frequencies of sound.

Another advantage of the invention is to provide a modular loudspeaker for a point sound source and its manufacturing method thereof, wherein during the sound recording, the treble region and bass region, including high pitch, the middle pitch and the lower pitch, of the sound are generated from an original point sound source at the same time, and, therefore, there is no need to divide the sound into different frequencies audio signals when the sound is transferred into audio signals but directly transmitting to the modular loudspeaker in a point-to-point manner as point sound source to play. Therefore, the modular loudspeaker is able to completely restore the audio signal input as the original form to enable the listener to hear the sound quality of original raw audio signal as much as possible.

Another advantage of the invention is to provide a modular loudspeaker for a point sound source and its manufacturing method thereof, since the audio signal does not need to be divided into different frequencies, the audio signal is restored for transmission and live broadcasting in a quality lossless manner.

Another advantage of the invention is to provide a modular loudspeaker for a point sound source and its manufacturing method thereof, which comprises at least an active vibrator and at least a passive vibrator, wherein when the active vibrator is vibrated for sound generation in response to the audio signal input, the passive vibrator is driven to vibrate for auxiliary generation at the same time, so as to enhance the sound quality of the point sound source, especially for the bass effect of the sound, so as to produce full range of frequencies of sound.

Another advantage of the invention is to provide a modular loudspeaker for a point sound source and its manufacturing method thereof, wherein a vibration cavity is shared with the active vibrator and the passive vibrator, such that when active vibrator is vibrated to vibrate the air within the vibration cavity, the vibration will transmit to the passive vibrator so as to produce the point sound source.

Another advantage of the invention is to provide a modular loudspeaker for a point sound source and its manufacturing method thereof, wherein two or more modular loudspeakers can be supported by a supporting frame to form an audio system, such that the audio system can be selectively moved in front of the listener to achieve the near-field listening effect.

Another advantage of the invention is to provide a modular loudspeaker for a point sound source and its manufacturing method thereof, which is structural simple, is easy for mass production, and is suitable for mass production for different applications.

Additional advantages and features of the invention will become apparent from the description which follows, and may be realized by means of the instrumentalities and combinations particular point out in the appended claims.

According to the present invention, the foregoing and other objects and advantages are attained by a modular speaker which comprises at least an active vibrator, at least a passive vibrator, and a module housing. The active vibrator and the passive vibrator are coupled to the module housing to form a vibration cavity therewithin to share with the active vibrator and the passive vibrator. When the active vibrator is operated for sound generation in response to an audio signal input, the passive vibrator is driven to vibrate through the vibration cavity for auxiliary sound generation so as to produce a point sound with full range of frequencies.

In one embodiment, the active vibrator and the passive vibrator can be assembled at the same side of the module housing or at different sides of the module housing.

In one embodiment, the active vibrator and the passive vibrator are coupled at two opposite sides of the module housing and are coaxially located back-to-back.

In one embodiment, the passive vibrator comprises a vibrating element and an elastic suspension outwardly extended from a peripheral edge of the vibrating element to a fixing frame.

In one embodiment, the active vibrator has a traditional speaker structure.

In one embodiment, the active vibrator comprises a vibrating body, a surround outwardly extended from a peripheral edge of the vibrating body, a voice coil operatively coupled to the vibrating body, and an electromagnetic mechanism operatively linked to the voice coil for electromagnetic induction with the voice coil.

In one embodiment, the active vibrator further comprises a reinforcing member which is made of the same material of the surround, wherein the reinforcing member is integrally extended from the surround to cover on at least a surface of the vibrating body.

In one embodiment, the reinforcing member has a plurality of openings.

In one embodiment, the passive vibrator further comprises a reinforcing element which is made of the same material of the suspension, wherein the reinforcing element is integrally extended from the suspension to cover on at least a surface of the vibrating element.

In one embodiment, the elastic suspension is outwardly extended to couple with an opening rim of the module housing or is coupled to a fixing frame which is coupled to the module housing.

In one embodiment, two or more of the point sound source modules of the present invention are linked together on a supporting frame in series that the point sound source modules are supported side-by-side to form a sound bar system.

In one embodiment, the electromagnetic mechanism is operatively coupled to a mounting frame which has a plurality of positioning slots, wherein the vibration frame has a plurality of positioning protrusions extended from a rear side thereof to engage with the positioning slots, such that the vibration frame is coupled to the mounting frame.

In one embodiment, the vibration frame of the active vibrator is coupled at one opening end of the module housing and the passive vibrator is coupled at an opposed opening end of the module housing to form the vibration cavity within the module housing at a position between the active vibrator and the passive vibrator.

In accordance with another aspect of the invention, the present invention comprises a manufacturing method of the modular speaker, which comprises the following steps.

(a) Coaxially align the active vibrator with the passive vibrator.

(b) Form the vibration cavity as a closed and shared cavity between the active vibrator with the passive vibrator, wherein when the active vibrator is vibrated for sound generation in response to the audio signal input, the passive vibrator is driven to vibrate for auxiliary sound generation so as to produce a full range of point sound source.

In one embodiment, the active vibrator is manufactured by a traditional speaker manufacturing process to have a traditional speaker structure.

In the step (b), the active vibrator and the passive vibrator are coupled to the module housing to form the vibration cavity therewithin as the closed cavity.

In one embodiment, the vibration frame is formed by mold injection to have the frame cavity and the positioning protrusions. Then, the vibrating body and the vibration frame are disposed in the mold at a position that the vibrating body is coaxially located within the frame cavity of the vibration frame. When the liquid raw material, such as rubber, is injected into the mold, the raw material between the vibrating body and the vibration frame will form the surround and the raw material on the vibrating body will form the reinforcing member. Then, the voice coil is coupled to the vibrating body and the electromagnetic mechanism is operatively coupled to the voice coil.

In one embodiment, the electromagnetic mechanism of the active vibrator can be made by the following process. A magnetic iron, a permanent magnet, and a pole panel are disposed in an injection mold, wherein injection material is injected into the injection mold to connect the magnetic iron, the permanent magnet, and the pole panel together to form the electromagnetic mechanism. The mounting frame is integrally formed by mold injection and is coupled to the electromagnetic mechanism, wherein the voice coil is coupled to the vibration frame to operatively communicate with the electromagnetic mechanism. The mounting frame is coupled to the vibration frame via a connection structure to form an integrated speaker module. The connection structure can be a snap-clip connection, tongue-groove connection, heat melting connection, ultrasonic connection, and the like.

In one embodiment, the mounting frame has a plurality of positioning slots, wherein the vibration frame has a plurality of positioning protrusions extended from a rear side thereof. Accordingly, the positioning protrusions are engaged and heat-melted with the positioning slots, such that the vibration frame is coupled to the mounting frame.

In one embodiment, when the liquid raw material, such as rubber, is injected into the mold, the raw material between the vibrating body and the vibration frame will form the surround and the raw material on the vibrating body will form the reinforcing member.

In one embodiment, the vibrating element as the weighting element and the module housing are disposed in the mold at a position that the vibrating element is coaxially located within the opening of the module housing. The liquid raw material, such as rubber, is injected into the mold, such that the raw material between the opening rim of the module housing and the vibration element forms the suspension and the raw material on the vibration element forms the reinforcing element, so as to integrally link the passive vibrator with the module housing.

In one embodiment, the step (b) of the method further comprises the steps of coupling the vibration frame of the active vibrator at one opening end of the module housing and coupling the passive vibrator at an opposed opening end of the module housing to form the vibration cavity within the module housing at a position between the active vibrator and the passive vibrator.

In one embodiment, the vibration frame of the active vibrator can be coupled to the module housing via different methods, such as snap-clip connection method, tongue-groove connection method, heat melting connection method, ultrasonic connection method, to form the point sound source module of the present invention.

In one embodiment, the module housing, having a hollow structure, has a main body portion and a base portion. The passive vibrator is coupled to the base portion to define the second chamber. The electromagnetic mechanism and the voice coil are disposed and encircled within the main body portion to define the third chamber. The space between the vibrating body and the electromagnetic mechanism forms the first chamber. The first chamber is communicatively linked to the second chamber through the third chamber.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
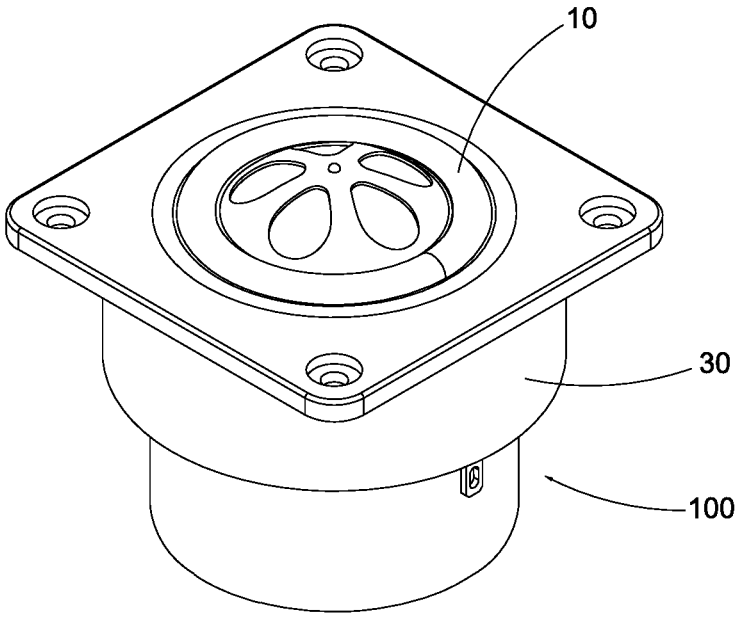
FIGS. 1A and 1B are perspective view of a point sound source module according to a preferred embodiment of the present invention.
Figure 1B:
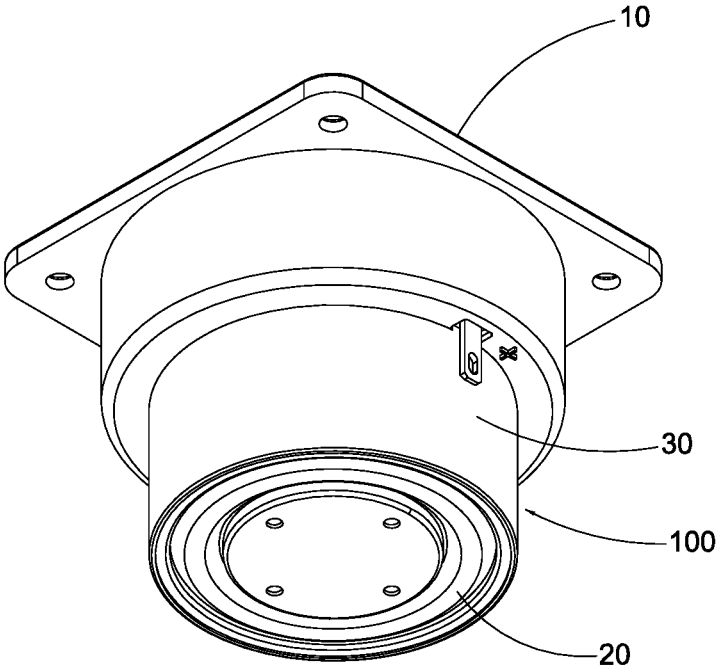
Figure 2:
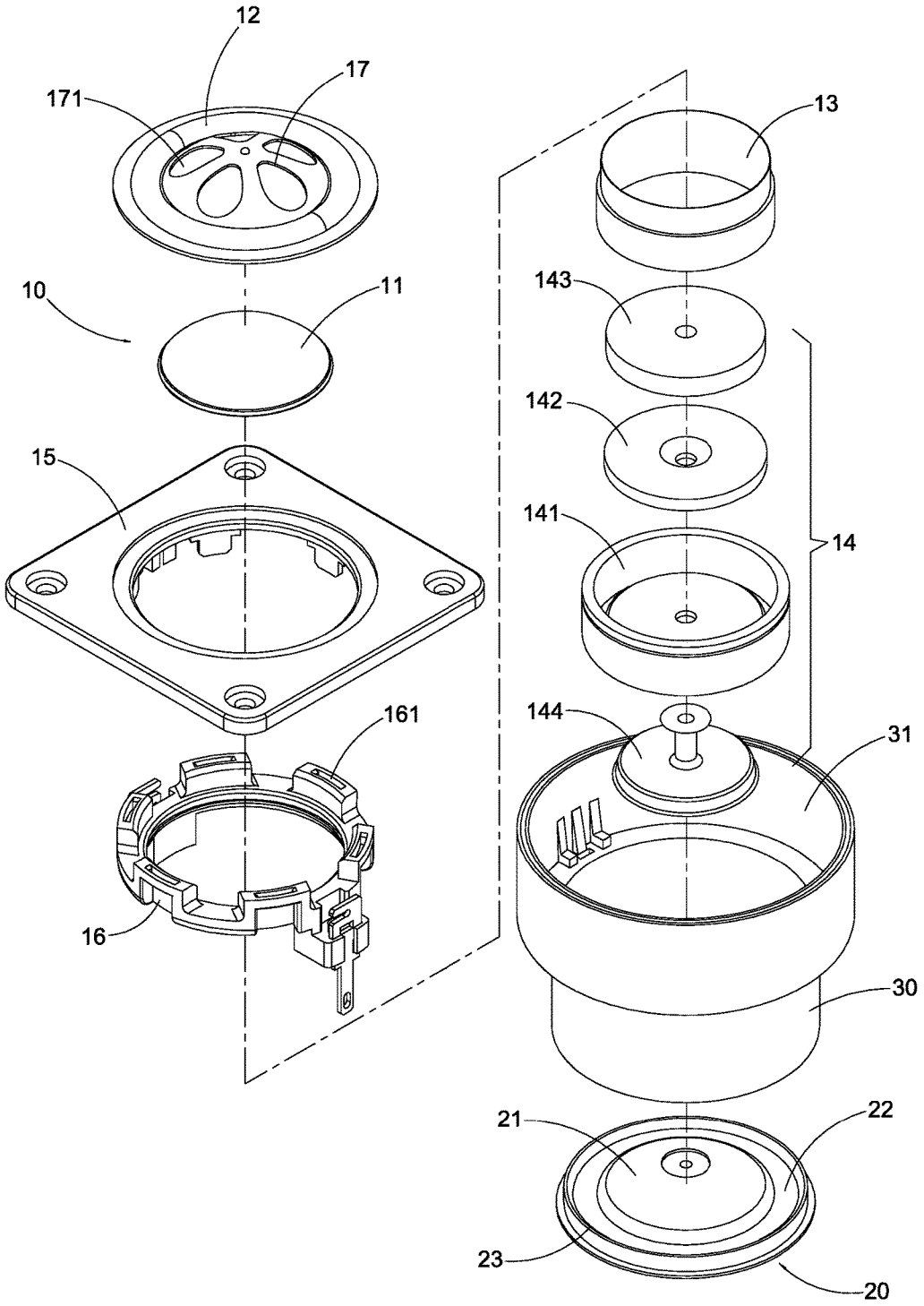
FIG. 2 is an exploded perspective view of the point sound source module according to the above preferred embodiment of the present invention.
Figure 3A:
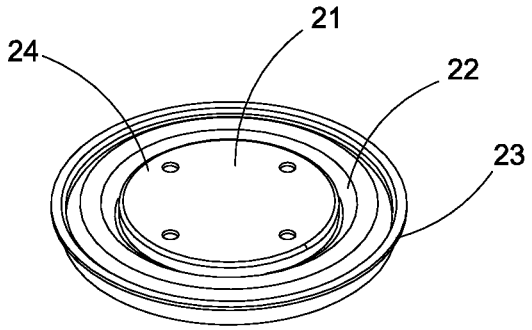
FIGS. 3A and 3B are perspective view of the passive vibrator of the point sound source module according to the above preferred embodiment of the present invention.
Figure 3B:
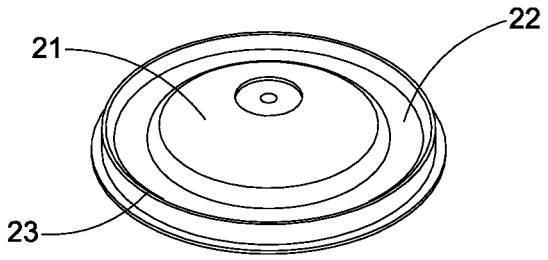
Figure 4:
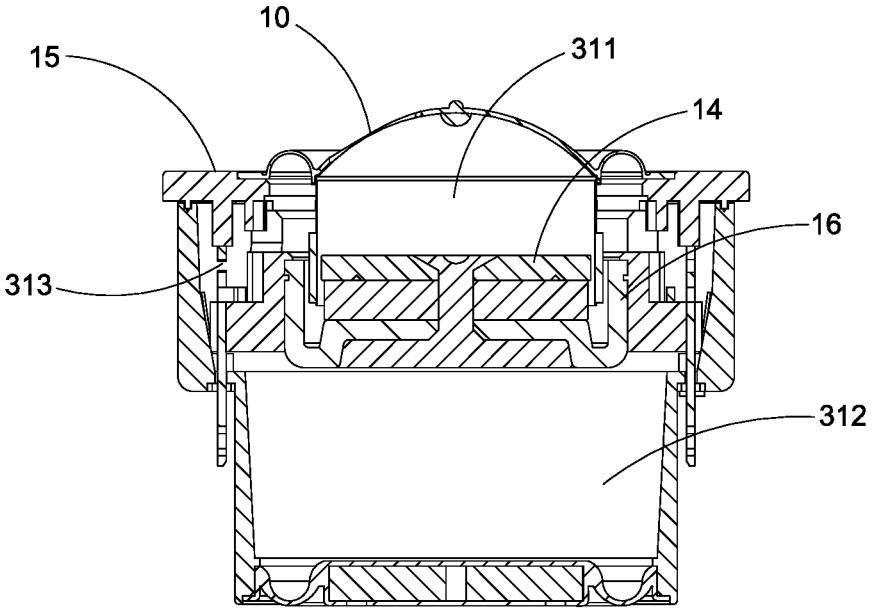
FIG. 4 is a sectional view of the point sound source module according to the above preferred embodiment of the present invention.
Figure 5:
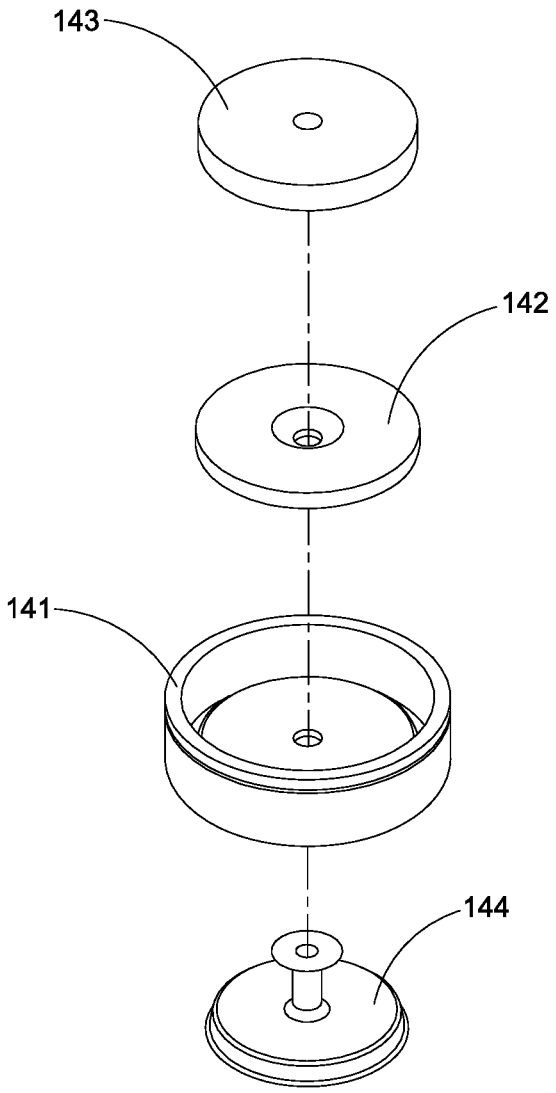
FIG. 5 is an exploded perspective view of an electromagnetic mechanism of the point sound source module according to the above preferred embodiment of the present invention.
Figure 6:
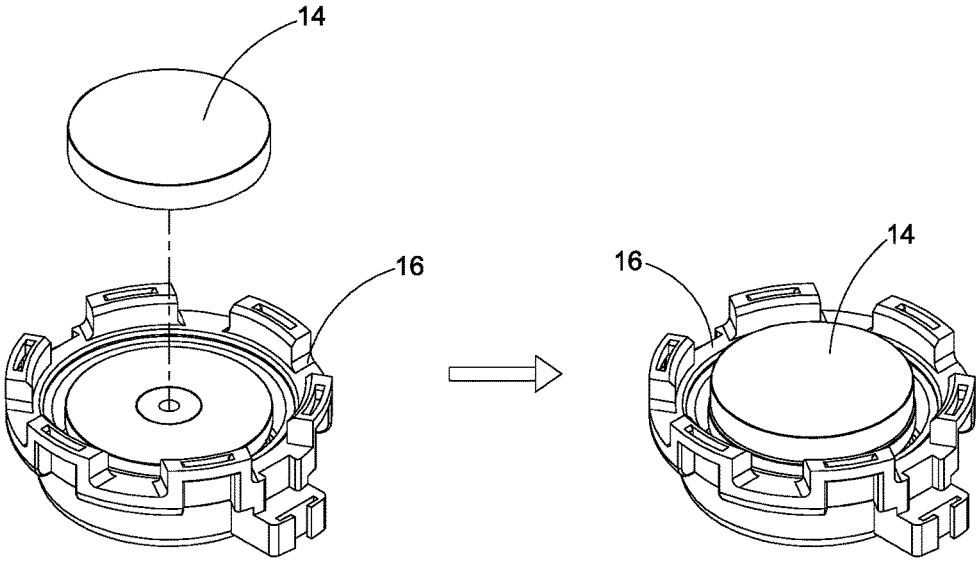
FIG. 6 illustrates the electromagnetic mechanism to be coupled with the mounting frame of the point sound source module according to the above preferred embodiment of the present invention.
Figure 7A:
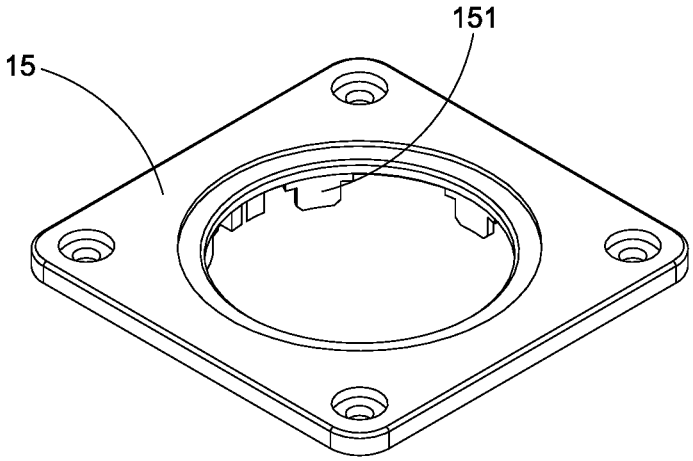
FIGS. 7A and 7B are perspective view of the vibration frame of the point sound source module according to the above preferred embodiment of the present invention.
Figure 7B:
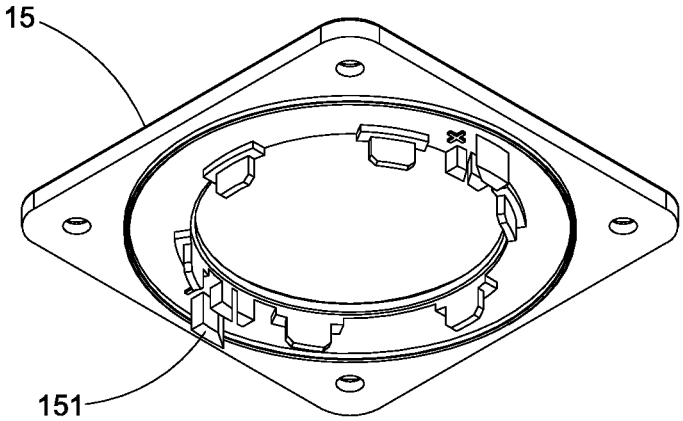
Figure 8:
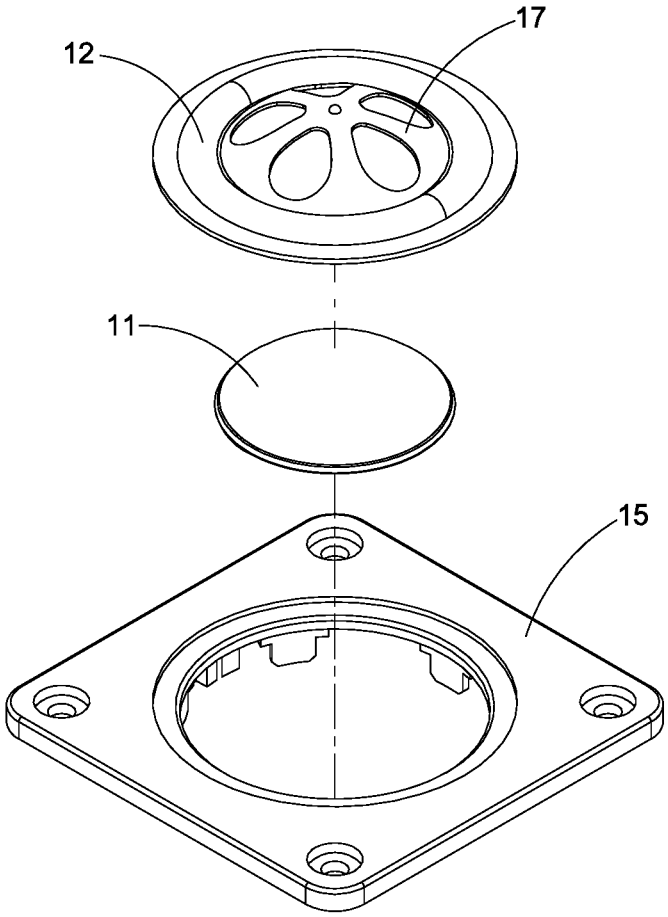
FIG. 8 is an exploded perspective view of the active vibrator of the point sound source module according to the above preferred embodiment of the present invention.
Figure 9A:
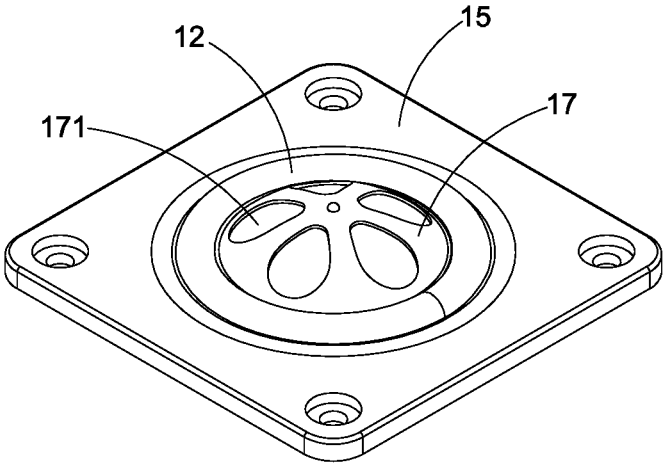
FIGS. 9A and 9B are perspective view of the active vibrator of the point sound source module according to the above preferred embodiment of the present invention.
Figure 9B:
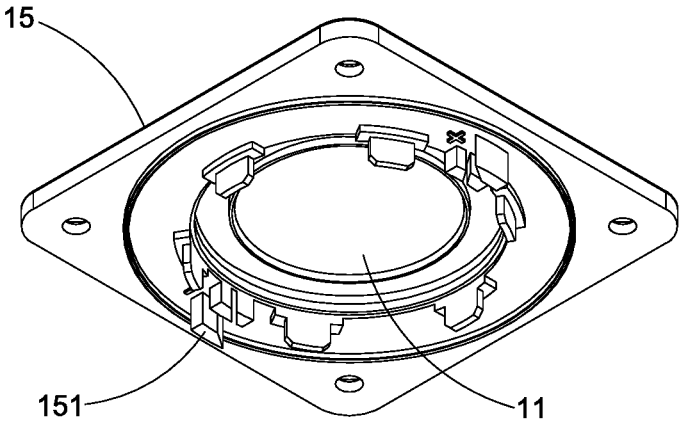
Figure 10:
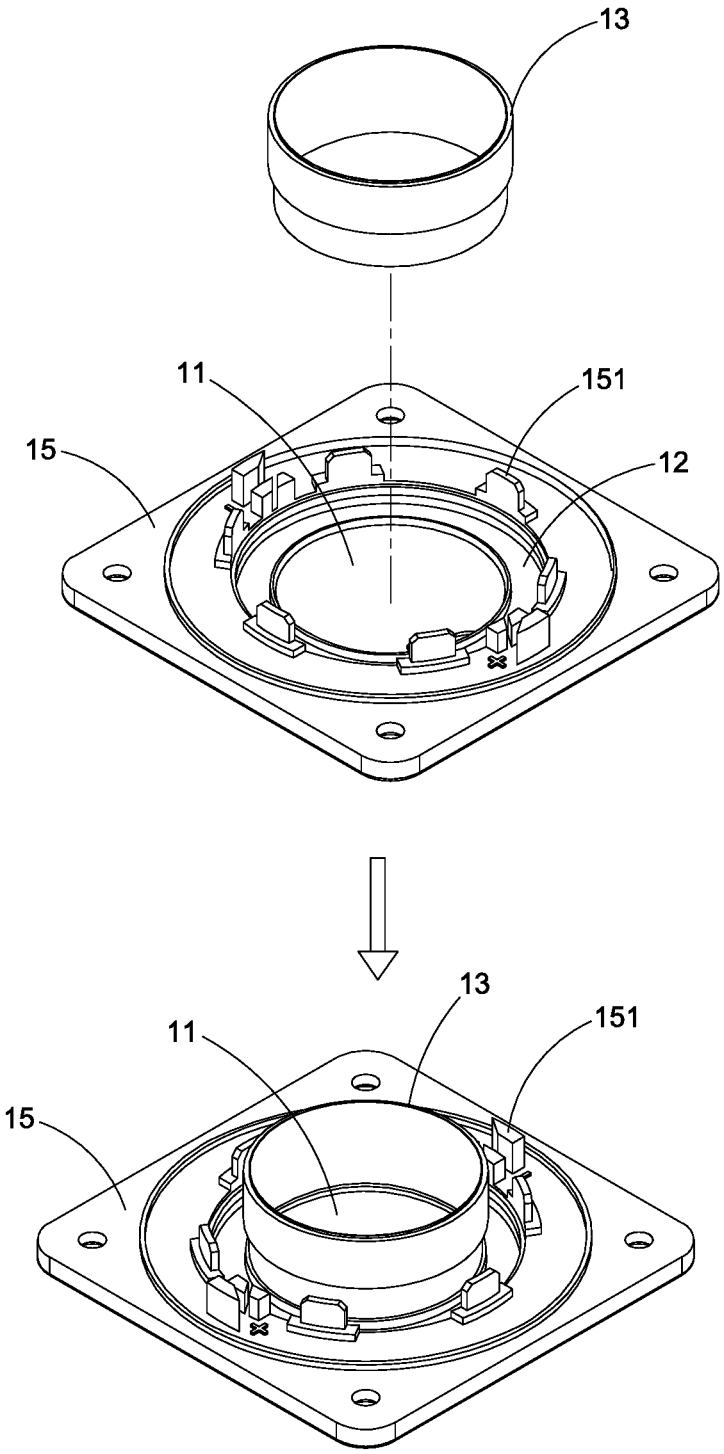
FIG. 10 is an exploded perspective view of the active vibrator of the point sound source module according to the above preferred embodiment of the present invention, illustrating the manufacturing step of the voice coil.
Figure 11:
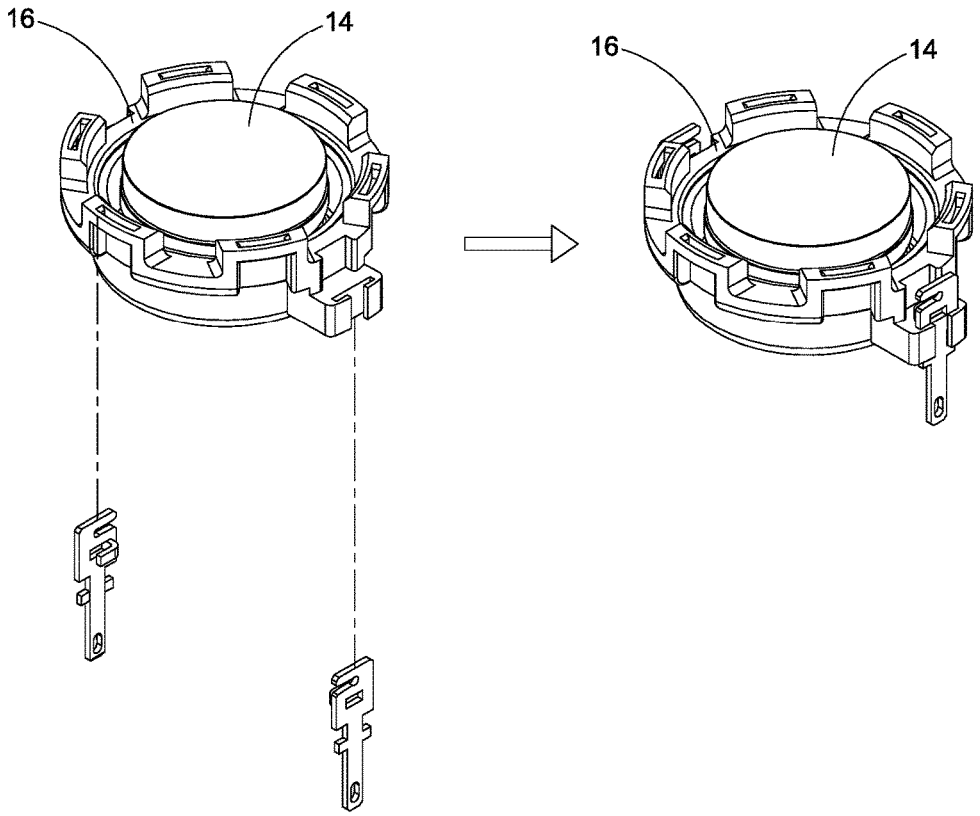
FIG. 11 is a perspective view of the active vibrator of the point sound source module according to the above preferred embodiment of the present invention, illustrating the manufacturing step of the terminals.
Figure 12:
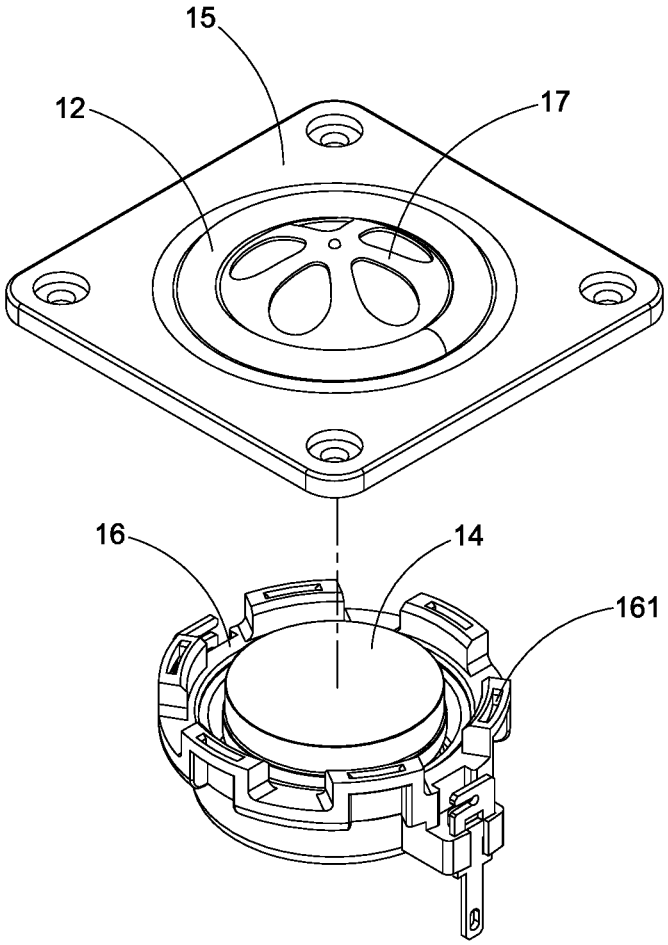
FIG. 12 is an exploded perspective view of the active vibrator of the point sound source module according to the above preferred embodiment of the present invention, illustrating the manufacturing step of the vibration frame.
Figure 13A:
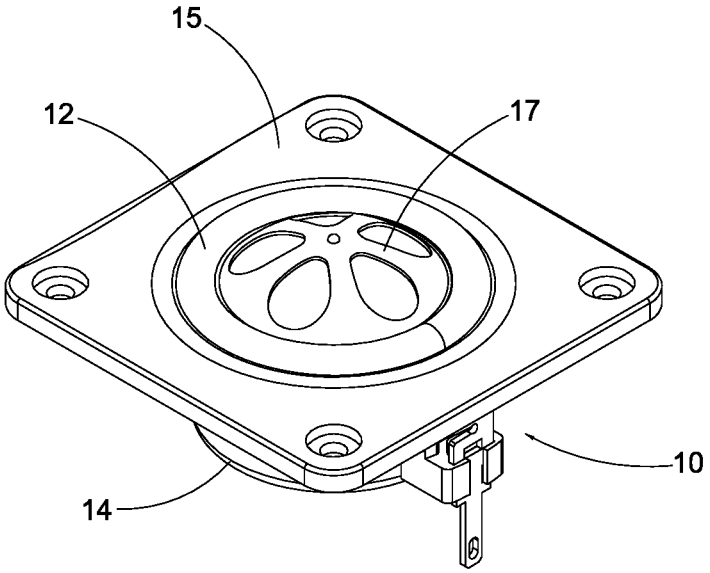
FIGS. 13A and 13B is an exploded perspective view of the active vibrator of the point sound source module according to the above preferred embodiment of the present invention.
Figure 13B:
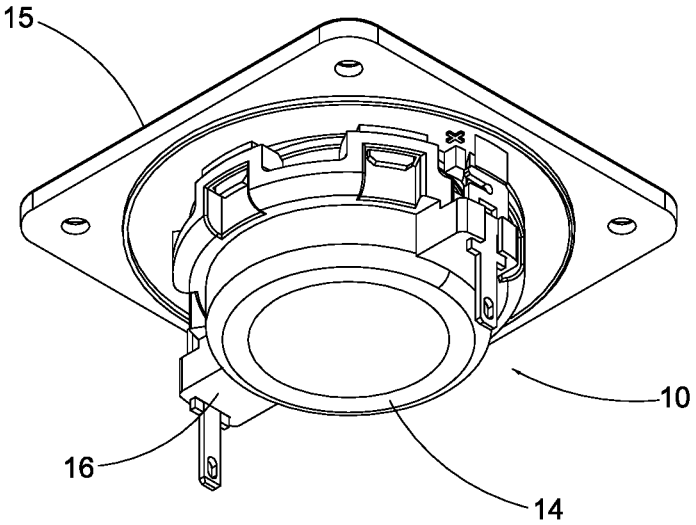
Figure 14:
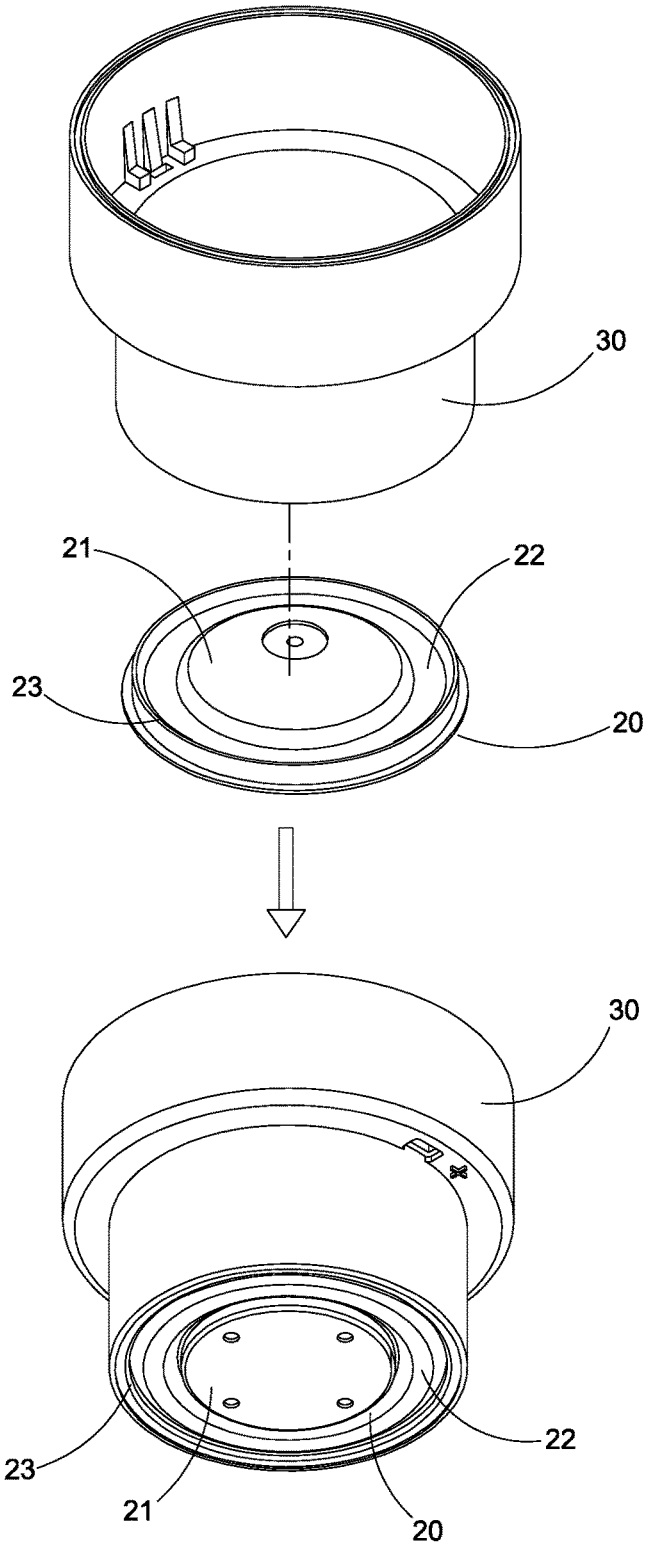
FIG. 14 a perspective view of the passive vibrator of the point sound source module according to the above preferred embodiment of the present invention, illustrating the passive vibrator coupled to the module housing.
Figure 15:
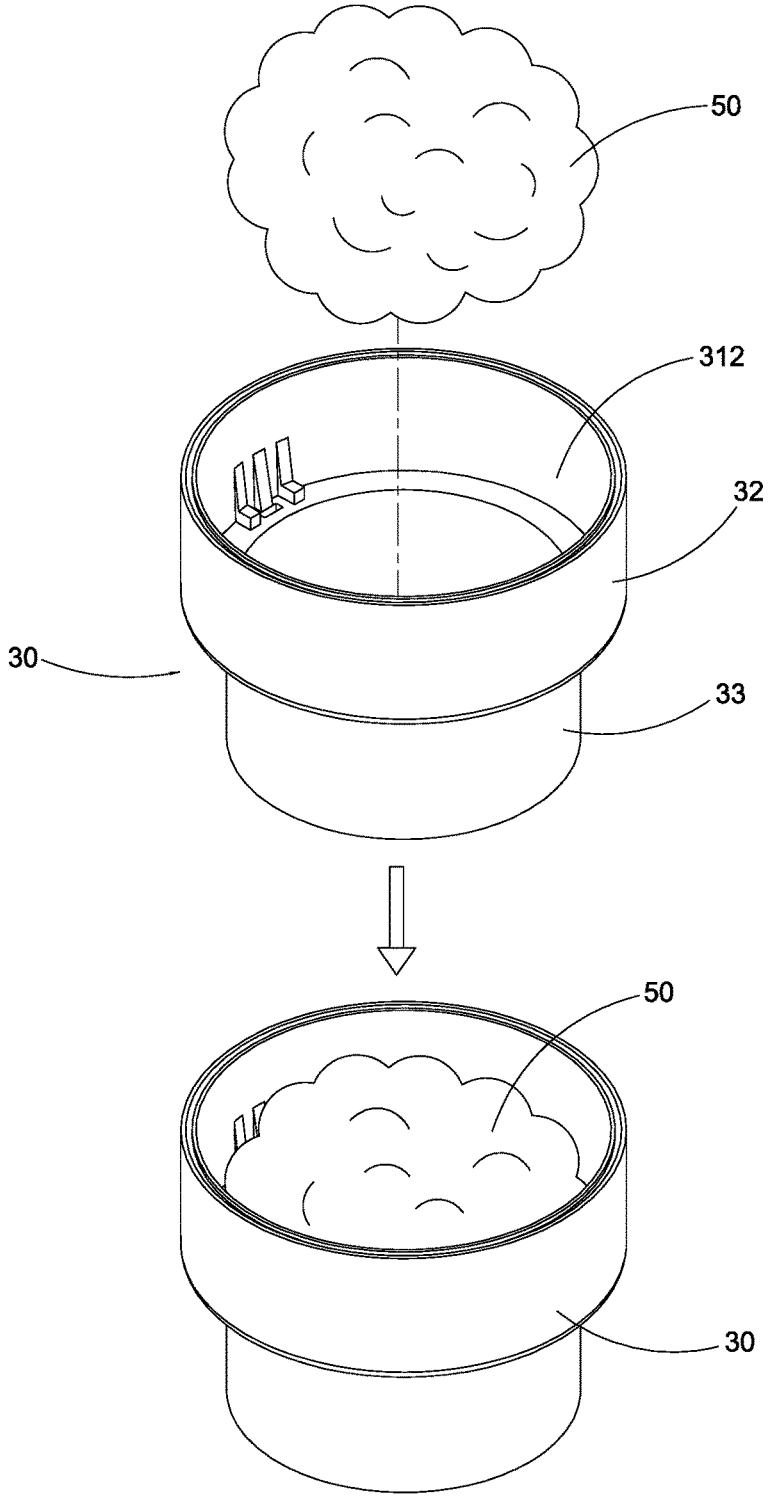
FIG. 15 a perspective view of the module housing of the point sound source module according to the above preferred embodiment of the present invention, illustrating the sound absorbing material disposed in the module housing.
Figure 16:
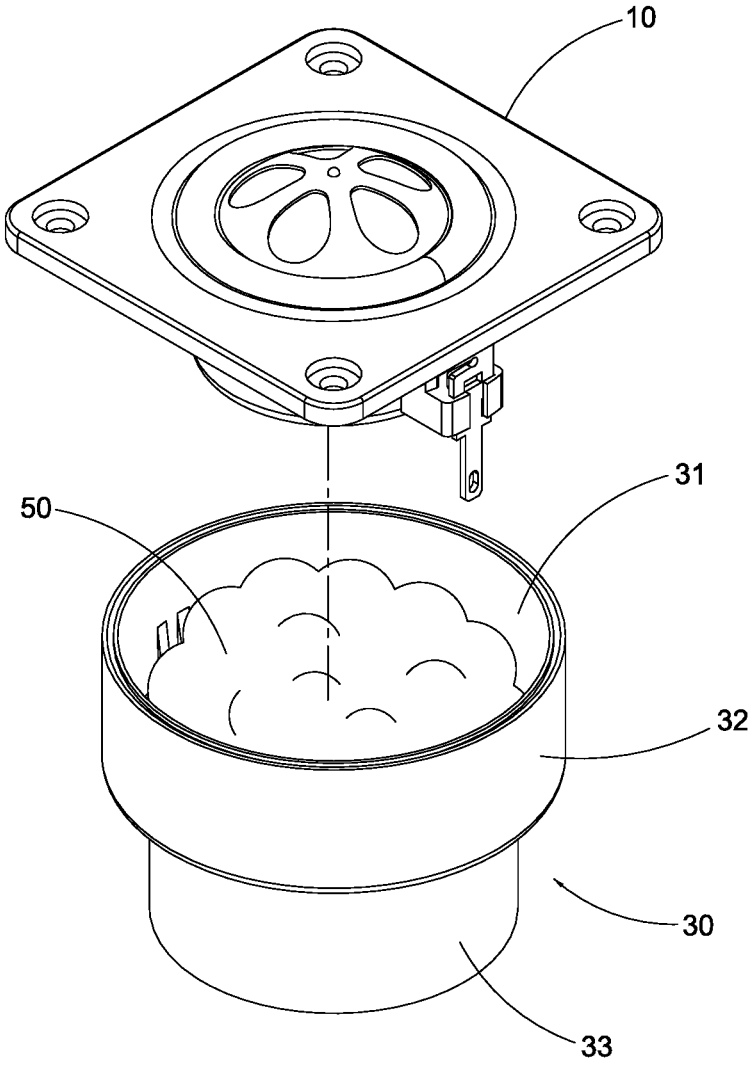
FIG. 16 a perspective view of the module housing of the point sound source module according to the above preferred embodiment of the present invention, illustrating the active vibrator coupled to the module housing with the sound absorbing material disposed therein.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1A to 4 of the drawings, a point sound source module 100 according to a preferred embodiment of the present invention is illustrated, wherein the point sound source module 100, which serves as a modular speaker, comprises at least an active vibrator 10 and at least a passive vibrator 20. The operation of the vibration speaker 10 for sound generation is that the active vibrator 10 is vibrated in response to an audio signal input. The operation of the passive vibrator 20 for auxiliary sound generation is that the passive vibrator 20 is vibrated in response to the active vibrator 10. In other words, the passive vibrator 20 will not be directly operated in response to the audio signal input. The passive vibrator 20 will be operated by the vibration of the active vibrator 10. The passive vibrator 20 will enhance the overall sound quality of the speaker, especially the bass thereof.

According to the preferred embodiment, the audio signal input is a sound point of the point sound source module 100 for generating both the treble frequencies and bass frequencies at the same time, so as to produce a full range of frequencies from the sound point. In other words, the present invention provides a single sound point source of the speaker does not require converting the single sound point source of the audio signal input into treble region and bass region by different sound converting mechanisms and then re-generating back to the audio sound as multiple sound sources by different sound generation mechanisms. The present invention is able to produce the treble frequencies and bass frequencies at the same time, so as to produce a point sound with full range of frequencies.

When the point sound source module 100 converts and produces the sound signal, the treble frequencies and bass frequencies as the single point source at the same time, the human ear is able to naturally separate the single point source from the point sound module 100 into treble region and bass region by means of human auditory system, in resulting a full range sound experience. In other words, when the audio signal input is live-recorded or obtained in other ways as the single point source, the point sound source module 100 of the present invention will completely restore the audio signal input as the original form to enable the listener to hear the sound quality of original raw audio signal.

The point sound source module 100 of the present invention as shown in the figures comprises the active vibrator 10 and the passive vibrator 20, wherein the active vibrator 10 and the passive vibrator 20 are assembled together by a module housing 30. Accordingly, the active vibrator 10 and the passive vibrator 20 can be assembled at the same side of the module housing 30 or at different sides of the module housing 30. In one embodiment, the active vibrator 10 and the passive vibrator 20 are assembled at two opposite sides of the module housing 30 respectively. In other words, the active vibrator 10 and the passive vibrator 20 are coaxial with each other at the opposite sides of the module housing 30.

Accordingly, the module housing 30 has a vibration cavity 31 formed between the active vibrator 10 and the passive vibrator 20, wherein the active vibrator 10 and the passive vibrator 20 share the same vibration cavity 31. In other words, the active vibrator 10 and the passive vibrator 20 are located back-to-back to define the vibration cavity 31 therebetween. Therefore, when the active vibrator 10 is operated and vibrated in response to the audio signal input, air within the vibration cavity 31 is correspondingly vibrated for sound generation. At the same time, the air within the vibration cavity 31 is vibrated to drive the passive vibrator 20 to vibrate for auxiliary sound generation.

In other words, the vibration cavity 31 provided by the point sound source module 100 of the present invention will ensure the air within the vibration cavity 31 to be vibrated so as to vibrate the active vibrator 10 and the passive vibrator 20 at the same time for producing pure and clean sound.

The structure of the active vibrator 10 can be any traditional speaker that when the active vibrator 10 receives the audio signal input, the active vibrator 10 will be vibrated to generate sound. In the preferred embodiment of the present invention, the active vibrator 10 comprises a vibrating body 11, such as a vibrating panel, a surround 12 outwardly extended from a peripheral edge of the vibrating body 11, a voice coil 13 operatively coupled to the vibrating body 11, and an electromagnetic mechanism 14 operatively linked to the voice coil 13 for electromagnetic induction with the voice coil 13. Accordingly, conductive cables, terminals, and other necessary components are provided for the voice coil 13 and the electromagnetic mechanism 14. The active vibrator 10 further comprises a vibration frame 15, having a frame cavity, coupled to the opening of the module housing 30, wherein the vibrating body 11 is disposed within the frame cavity of the vibration frame 15 at a position that the surround 12 is outwardly extended from the vibrating body 11 to the inner edge peripheral edge of the vibration frame 15. The voice coil 13 and the electromagnetic mechanism 14 are operatively coupled to the vibration frame 15 via a connection structure to form an integrated speaker module. The connection structure can be a snap-clip connection, tongue-groove connection, heat melting connection, ultrasonic connection, and the like. In one embodiment, the electromagnetic mechanism 14 is operatively coupled to a mounting frame 16 which has a plurality of positioning slots 161, wherein the vibration frame 15 has a plurality of positioning protrusions 151 extended from a rear side thereof. Accordingly, the positioning protrusions 151 are engaged and heat-melted with the positioning slots 161, such that the vibration frame 15 is coupled to the mounting frame 16. It is worth mentioning that the vibration frame 15 is coupled to the mounting frame 16, wherein the positioning protrusions 151 are spacedly located at a circumferential direction around the frame cavity of the vibration frame 15. As a result, when the electromagnetic mechanism 14 is operatively coupled to the vibration frame 15 through the mounting frame 16, the vibrating body 11 is positioned closed enough with the electromagnetic mechanism 14 to define a gap therebetween. In other words, the gap will ensure the vibration of the vibrating body 11 to vibrate the air within the vibration cavity 31 so as to drive the passive vibrator 20 to vibrate.

According to the preferred embodiment, the passive vibrator 20 comprises a vibrating element 21 and an elastic suspension 22 outwardly extended from a peripheral edge of the vibrating element 21 to one side of the module housing 30. Alternatively, the elastic suspension 22 is coupled to a fixing frame 23 which is coupled to the module housing 30.

The module housing 30 has a hollow structure defining the vibration cavity 31 between two openings of the module housing 30. In particular, the vibration frame 15 and the fixing frame 23 are coupled at the openings of the module housing 30 respectively, wherein the vibration cavity 31 is formed between the vibration frame 15 and the fixing frame 23 to form a closed cavity. Therefore, the active vibrator 10 and the passive vibrator 20 are vibrated in response to the air vibration within the vibration cavity 31 of the module housing 30.

In other words, the vibration cavity 31 is divided into three portions, i.e. a first chamber 311, a second chamber 312, and a third chamber 313. The active vibrator 10 is coupled with the module housing 30, wherein the first chamber 311 is defined at a space between the vibrating body 11 and the electromagnetic mechanism 14. The second chamber 312 is defined at a space between the electromagnetic mechanism 14 of the active vibrator 10 and the vibrating element 21 of the passive vibrator 20. The third chamber 313 is defined at a space between the electromagnetic mechanism 14 and the mounting frame 16. The first chamber 311 is communicated with the second chamber 312 through the third chamber 313. In other words, the third chamber 313 serves as a communication link between the first chamber 311 and the second chamber 312. When the air pressure within the first chamber 311 is changed, the air pressure change in the first chamber 311 will transfer to the second chamber 312 through the third chamber 313. As a result, the air within the first chamber 311, the second chamber 312, and the third chamber 313 will be vibrated correspondingly. In other words, the active vibrator 10 and the passive vibrator 20 are correspondingly vibrated at the same time to generate a full range of point sound source including treble frequencies and bass frequencies.

Accordingly, when the voice coil 13 receives the audio signal input, the voice coil 13 is driven to reciprocatingly moved in response to an electromagnetic force from the electromagnetic mechanism 14, so as to drive the vibrating body 11 to vibrate. The surround 12 will ensure the vibrating body 11 to vibrate along an axial direction of the active vibrator 10. The vibration of the active vibrator 10 will vibrate the air within the vibration cavity 31 to drive the passive vibrator 20 to vibrate. The elastic suspension 22 will ensure the vibrating element 21 to vibrate along an axial direction of the passive vibrator 20 which is preferably the same axial direction of the active vibrator 10. As a result, when the active vibrator 10 is vibrated for sound generation, the passive vibrator 20 is correspondingly vibrated for generating the auxiliary sound.

In particular, the active vibrator 10 is coaxially aligned with the passive vibrator 20 that the axial direction of the active vibrator 10 is the same as the axial direction of the passive vibrator 20. For example, when the voice coil 13 is reciprocatingly moved up along the axial direction of the active vibrator 10 in response to the electromagnetic force from the electromagnetic mechanism 14, the vibrating body 11 coaxially coupled at the voice coil 13 is driven to moved up. Due to the air pressure change within the vibration cavity 31, the vibrating element 21 of the passive vibrator 20 is driven to move up correspondingly. Likewise, when the voice coil 13 is reciprocatingly moved down along the axial direction of the active vibrator 10 in response to the electromagnetic force from the electromagnetic mechanism 14, the vibrating body 11 coaxially coupled at the voice coil 13 is driven to moved down, such that the vibrating element 21 of the passive vibrator 20 is driven to move down correspondingly. In other words, the vibrating element 21 of the passive vibrator 20 is driven to reciprocatingly move up-and-down corresponding to the reciprocating movement of the vibrating body 11 of the active vibrator 10 along the same axial direction.

According to the preferred embodiment, the active vibrator 10 further comprises a reinforcing member 17 which is made of the same material of the surround 12, wherein the reinforcing member 17 is integrally extended from the surround 12 to cover on at least a surface of the vibrating body 11. Preferably, the reinforcing member 17 is formed as a layer covering on the peripheral edge of the vibrating body 11 at a top surface thereof and integrally extending to the surround 12, such that the peripheral edge of the vibrating body 11 is embedded in the reinforcing member 17 to reinforce the connection structure between the vibrating body 11 and the surround 12. A plurality of openings 171 are formed at the reinforcing member 17 on the vibrating body 11, which can minimize the material to be used for the reinforcing member 17 and can enhance the aesthetic appearance of the active vibrator 10.

Likewise, the passive vibrator 20 further comprises a reinforcing element 24 which is made of the same material of the suspension 22, wherein the reinforcing element 24 is integrally extended from the suspension 22 to cover on at least a surface of the vibrating element 21. Preferably, the reinforcing element 24 is formed as a layer covering on a bottom surface of the vibrating element 21 and integrally extending to the suspension 22, such that the vibrating element 21 is embedded in the reinforcing element 24 to reinforce the connection structure between the vibrating element 21 and the suspension 22. A plurality of openings are formed on the reinforcing element 24, which can minimize the material to be used for the reinforcing element 24 and can enhance the aesthetic appearance of the passive vibrator 20.

The vibrating body 11, the surround 12 and the reinforcing member 17 of the active vibrator 10 are made by the mold injection that the vibrating body 11 is disposed in a mold and raw material is injected into the mold to form the surround 12 and the reinforcing member 17 and to couple the vibrating body 11 with the surround 12 and the reinforcing member 17. Likewise, the vibrating element 21, the suspension 22, the fixing frame 23, and the reinforcing element 24 of the passive vibrator 20 are also made by the mold injection that the vibrating element 21 and the fixing frame 23 are disposed in the mold and liquid raw material is injected into the mold to form the suspension 22 and the reinforcing element 24. The raw material between the vibrating element 21 and the fixing frame 23 will form the suspension 22 and the raw material on the vibrating element 21 will form the reinforcing element 24. It is worth mentioning that the vibrating element 21 serves as a weighting element, wherein the reinforcing element 24 can enclose the upper surface and the bottom surface of the vibrating element 21 to embed the vibrating element 21 within the reinforcing element 24 and to increase the weight of the vibrating element 21.

It is worth mentioning that the structure of the active vibrator 10 can be the same as that of the passive vibrator 20, wherein the active vibrator 10 can be made by the same mold injection for the passive vibrator 20. In particular, the active vibrator 10 and the passive vibrator 20 can be identical to form a symmetrical structure at two opposite sides of the module housing 30. Therefore, when the air within the vibration cavity 31 is vibrated, the air at two opposite sides of the module housing 30 will be vibrated symmetrically for producing clean and pure sound.

For example, when the vibrating body 11 of the active vibrator 10 is vibrated and moved out of the vibration cavity 31, the air within vibration cavity 31 is correspondingly shifted toward the vibrating body 11, such that the vibrating element 21 of the passive vibrator 20 is driven to move into the vibration cavity 31 toward the vibrating body 11 of the active vibrator 10. Likewise, when the vibrating body 11 of the active vibrator 10 is vibrated and moved into the vibration cavity 31, the air within vibration cavity 31 is correspondingly shifted toward the vibrating element 21, such that the vibrating element 21 of the passive vibrator 20 is driven to move out of the vibration cavity 31 away from the vibrating body 11 of the active vibrator 10. As a result, the active vibrator 10 and the passive vibrator 20 will produce the clean and pure point source of sound without any noise generation.

Figure 17:
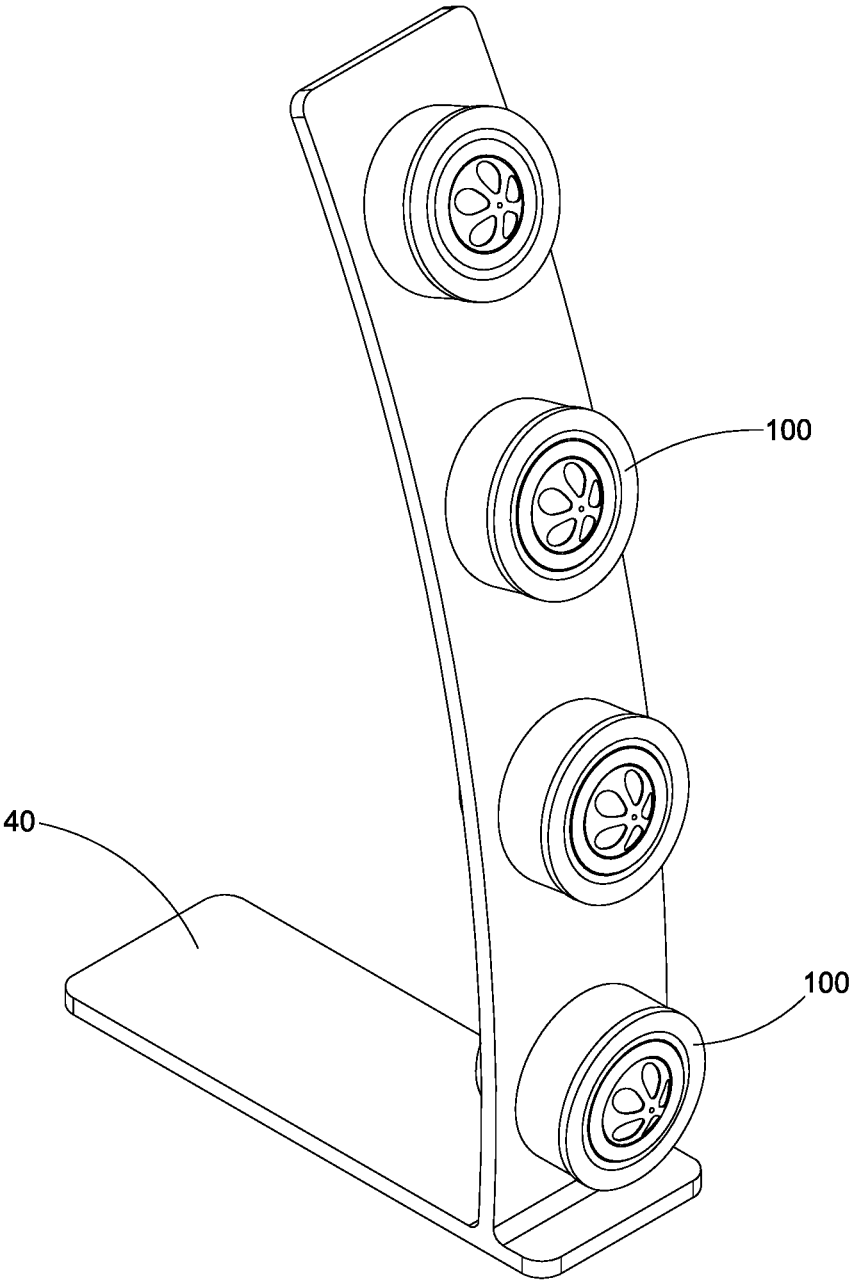
FIG. 17 a perspective view of an audio system according to the above preferred embodiment of the present invention, illustrating two or more of the point sound source modules coupled to the supporting frame.

As shown in FIG. 17, two or more of the point sound source modules 100 of the present invention can be linked together on a supporting frame 40 in series that the point sound source modules 100 are supported side-by-side to form a sound bar system. It is worth mentioning that the supporting frame 40 can be modified to have different sizes and shapes for supporting various numbers of point sound source modules 100 depending on different sound environmental requirements. In other words, numbers of active vibrators 10 and passive vibrators 20 of the present invention can be selectively configured. In addition, the point sound source module 100 of the present invention can also incorporate with any existing speaker system to configure an audio system in order to meet the requirements and preferences.

As shown in FIGS. 5 to 16, the present invention further provides a method of manufacturing the point sound source module 100 which comprises the following steps.

(a) Coaxially align the active vibrator 10 with the passive vibrator 20.

(b) Form the vibration cavity 31 as a closed and shared cavity between the active vibrator 10 with the passive vibrator 20, wherein when the active vibrator 10 is vibrated for sound generation in response to the audio signal input, the passive vibrator 20 is driven to vibrate for auxiliary sound generation so as to produce a full range of point sound source.

It is worth mentioning that the active vibrator 10 can be manufactured by a traditional speaker manufacturing process to have a traditional speaker structure.

In the step (b), the active vibrator 10 and the passive vibrator 20 are coupled to the module housing 30 to form the vibration cavity 31 therewithin as the closed cavity.

According to the preferred embodiment, the electromagnetic mechanism 14 of the active vibrator 10 can be made by the following process. A magnetic iron 141, a permanent magnet 142, and a pole panel 143 are disposed in an injection mold, wherein injection material is injected into the injection mold to form a fastener member 144 in order to connect the magnetic iron 141, the permanent magnet 142, and the pole panel 143 together to form the electromagnetic mechanism 14. It is appreciated that the electromagnetic mechanism 14 can be made by the traditional methods, such as pressurized lamination or adhesive process. The electromagnetic mechanism 14 and the mounting frame 16 are also integrally formed by mold injection. The positioning slots 161 are integrally formed at the mounting frame 16. The voice coil 13 is formed to electromagnetically induce with the electromagnetic mechanism 14. The vibration frame 15 is formed by mold injection to have the frame cavity and the positioning protrusions 151. Then, the vibrating body 11 and the vibration frame 15 are disposed in the mold at a position that the vibrating body 11 is coaxially located within the frame cavity of the vibration frame 15. When the liquid raw material, such as rubber, is injected into the mold, the raw material between the vibrating body 11 and the vibration frame 15 will form the surround 12, i.e. within the frame cavity of the vibration frame 15, and the raw material on the vibrating body 11 will form the reinforcing member 17. Preferably, the raw material will also cover on the vibration frame 15. Then, the voice coil 13 is coupled to the vibrating body 11, wherein the conductive cables and terminals are installed thereto. The vibration frame 15 and the mounting frame 16 can be coupled with each other by inserting the positioning protrusions 151 into the positioning slots 161 respectively and heat-melting the positioning protrusions 151 at the positioning slots 161 respectively, so as to form the active vibrator 10.

According to the preferred embodiment, the active vibrator 10 is coupled at one opening end of the module housing 30 and the passive vibrator 20 is coupled at an opposed opening end of the module housing 30. The passive vibrator 20 is manufactured as it is mentioned above. The vibrating element 21 as the weighting element and the module housing 30 are disposed in the mold at a position that the vibrating element 21 is coaxially located within the opening of the module housing 30. The liquid raw material, such as rubber, is injected into the mold, such that the raw material between the opening rim of the module housing 30 and the vibration element 21 forms the suspension 22 and the raw material on the vibration element 21 forms the reinforcing element 24, so as to integrally link the passive vibrator 20 with the module housing 30.

After the passive vibrator 20 is coupled to the module housing 30, the vibration frame 15 of the active vibrator 10 can be coupled to the module housing 30 via different methods, such as ultrasonic connecting method, to form the point sound source module 100 of the present invention.

It is worth mentioning that the sound absorbing material 50, such as sound absorbing fiber, can be disposed between the passive vibrator 20 and the module housing 30 to enhance the sound quality from the point sound source module 100 of the present invention.

According to the preferred embodiment, the module housing 30 can have a hollow structure, wherein the module housing 30 has a main body portion 32 and a base portion 33. The passive vibrator 20 is coupled to the base portion 33 to define the second chamber 312. The electromagnetic mechanism 14 and the voice coil 13 are disposed and encircled within the main body portion 32 to define the third chamber 313. The space between the vibrating body 11 and the electromagnetic mechanism 14 forms the first chamber 311. The first chamber 311 is communicatively linked to the second chamber 312 through the third chamber 313.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A modular speaker, comprising:

at least an active vibrator being operated for sound generation in response to an audio signal input;

at least a passive vibrator; and a module housing having a vibration cavity, wherein said active vibrator and said passive vibrator are coupled to said module housing to close said vibration cavity as a closed cavity that shares with said active vibrator and said passive vibrator, such that when said active vibrator is operated, said passive vibrator is vibrated within said vibration cavity for auxiliary sound generation, so as to produce a point sound with full range of frequencies including treble frequencies and bass frequencies, wherein said active vibrator and said passive vibrator are coupled at said two opposite sides of said module housing respectively, such that said active vibrator and said passive vibrator are coaxially located back-to-back, wherein said vibration cavity is formed between said active vibrator and said passive vibrator, wherein said passive vibrator comprises a vibrating element and a suspension outwardly extended from a peripheral edge of said vibrating element to an opening rim of said module housing, wherein said active speaker comprises a vibrating body, a surround outwardly extended from a peripheral edge of said vibrating body, a voice coil operatively coupled to said vibrating body for receiving said audio signal input, and an electromagnetic mechanism operative linked to said voice coil for electromagnetic induction with said voice coil, wherein said module housing, having a hollow structure, has a main body portion and a base portion, wherein said passive vibrator is coupled to said base portion to define a second chamber, wherein said electromagnetic mechanism and said voice coil are disposed and encircled within said main body portion to define a third chamber, wherein a space between said vibrating body and said electromagnetic mechanism forms a first chamber, wherein said first chamber is communicatively linked to said second chamber through said third chamber.

2. A method of manufacturing a modular speaker, comprising the steps of:

(a) forming a module housing having a vibration cavity; and (b) coupling an active vibrator and a passive vibrator to said module housing to close said vibration cavity as a closed cavity that shares with said active vibrator and said passive vibrator, such that when said active vibrator is operated, said passive vibrator is vibrated within said vibration cavity for auxiliary sound generation, so as to produce a point sound with full range of frequencies including treble frequencies and bass frequencies, wherein the step (b) further comprises a step of coupling said active vibrator and said passive vibrator at said two opposite sides of said module housing respectively, such that said active vibrator and said passive vibrator are coaxially located back-to-back to form said vibration cavity between said active vibrator and said passive vibrator, wherein said active vibrator is manufactured by the steps of: forming a vibration frame, which has a frame cavity, by mold injection; disposing a vibrating body and said vibration frame in a mold at a position that said vibrating body is coaxially located within said frame cavity of said vibrating frame; injecting liquid raw material into said mold, wherein said raw material on said vibrating body form a reinforcing member and said raw material between said vibrating body and said vibration frame form a surround; coupling a voice coil to said vibrating body; and operatively coupling an electromagnetic mechanism to said voice coil, wherein said module housing, having a hollow structure, has a main body portion and a base portion, wherein said passive vibrator is coupled to said base portion to define a second chamber, wherein said electromagnetic mechanism and said voice coil are disposed and encircled within said main body portion to define a third chamber, wherein a space between said vibrating body and said electromagnetic mechanism forms a first chamber, wherein said first chamber is communicatively linked to said second chamber through said third chamber.

* * * * *